United States Patent [19]

Kawakami et al.

[11] Patent Number: 4,800,744

[45] Date of Patent: Jan. 31, 1989

[54] PRODUCTION OF A TAPER ROD

[75] Inventors: Heijiro Kawakami; Yasunobu Kawaguchi; Kozo Katsube; Mamoru Murahashi; Susumu Takada, all of Kobe, Japan

[73] Assignee: Kabushiki Kaisha Kobe Seiko Sho, Kobe, Japan

[21] Appl. No.: 73,689

[22] Filed: Jul. 15, 1987

[30] Foreign Application Priority Data

Sep. 11, 1986 [JP] Japan ..... 61-214951
Sep. 16, 1986 [JP] Japan ..... 61-218869

[51] Int. Cl.[4] ..... B21C 37/04; B21F 35/00; B21F 37/04

[52] U.S. Cl. ..... 72/342; 72/38; 72/378

[58] Field of Search ..... 72/342, 378, 302, 183, 72/38

[56] References Cited

U.S. PATENT DOCUMENTS 3,225,508 12/1965 Simon ..... 72/378
4,007,616 2/1977 Aleck ..... 72/378

FOREIGN PATENT DOCUMENTS 56417 4/1985 Japan ..... 72/342
202723 9/1986 Japan ..... 72/342
206518 9/1986 Japan ..... 72/378
206520 9/1986 Japan ..... 72/378

*Primary Examiner*—Lowell A. Larson
*Attorney, Agent, or Firm*—Oblon, Fisher, Spivak, McCelland & Maier

[57] ABSTRACT

A tapered rod producing process by which a tapered rod having a profile very near to an aimed profile can be produced with high accuracy. According to the process, during working of a wire diameter gradually decreasing portion of a tapered rod in which the diameter of a stock gradually decreases in a feeding direction of the stock, the drawing length of the stock from starting to ending of acceleration of variable speed feeding mechanism is made greater than predetermined length of the wire diameter gradually decreasing portion, and during working of a wire diameter gradually increasing portion in which the diameter of the stock gradually increases, the drawing length of the stock from starting to completion of deceleration of the variable speed feeding mechanism is made smaller than an a desired length of the wire diameter gradually increasing portion of the tapered rod.

6 Claims, 11 Drawing Sheets

PRODUCTION OF A TAPER ROD

BACKGROUND OF THE INVENTION

1. Field of the Invention

This invention relates to a tapered rod producing process for working a stock in the form of a straight wire or bar into a tapered rod which is used as a taper coil spring for an automobile, a railway vehicle or the like.

2. Description of the Prior Art

Various processes and types of equipment for producing a tapered rod of the type mentioned are conventionally known. One of such conventional types of equipment is disclosed, for example, in Japanese Patent Laid-Open No. 60-56416 and Japanese Patent Laid-Open No. 60-56417, published Apr. 2, 1985. The equipment is illustratively shown in FIG. 1.

Referring to FIG. 1, the equipment shown is characterized in that it comprises two or more pairs of constant speed feed rollers 2 for holding and feeding a metal wire stock 1 at a constant speed, a heating device 3 located downstream of the constant speed feed rollers 2 in a direction of the metal wire stock 1 being fed, a cooling device 4 located further downstream of the heating device 3, two or more pairs of variable speed tension rollers 5 located further downstream of the cooling device 4 for holding and feeding the metal wire or bar stock 1 at a speed higher than the feeding speed of the constant speed feed rollers 2, and a speed controlling device 6 for controlling the speed of the variable speed tension rollers 5.

In this assembly, the feeding speed Vi of the variable speed tension rollers 5 is gradually accelerated or decelerated while remaining higher than the feeding speed Vo of the constant speed feed rollers 2 in order to provide a portion of the metal wire stock 1 between the heating device 3 and the cooling device 4 with tensile plastic deformation to work the straight metal wire stock 1 into a tapered rod 7.

The feeding speed Vi of the variable speed tension rollers 5 for providing a straight metal wire stock 1 with tensile deformation to work the metal wire stock 1 into a tapered shape is controlled under a hypothesis as illustrated in FIG. 2.

In particular, where the feeding speed of a metal wire stock 1 being supplied to the heating device 3 is denoted by Vo which is equal to the speed of the constant speed feed rollers 2, the sectional area of the metal wire stock 1 is denoted by Ao, the sectional area of the tapered rod 7 after the metal wire stock 1 has been heated, plastically worked and then cooled by the cooling device 4 until it has no more plastic deformation is denoted by Ai, and the feeding speed of the tapered rod 7 with the sectional area Ai is denoted by Vi, the following relation stands;

$$Ao \times Vo = Ai \times Vi$$

Accordingly, if the speed Vi of the variable speed tension rollers 5 is controlled in accordance with a relation $$Vi = \frac{Ao}{Ai} \cdot Vo$$

then a tapered rod 7 in which Ai gradually increases or decreases can be produced.

When variable speed control of the variable speed tension rollers 5 is considered under such a premise, it can be understood that the variable speed control should be accomplished by a combination of a straight line and simple curves in a V-t chart as shown in FIG. 3. It is to be noted that, in FIG. 3, V represents a feeding speed of a tapered rod 7 by the variable speed tension rollers 5, and t denotes time.

However, if a metal wire stock is actually worked to produce a tapered rod under such a variable speed control as illustrated in FIG. 3, there is a problem that a product of an a desired shape cannot be obtained in that, relative to an a desired shape indicated by broken lines in FIG. 4, the tapered rod becomes thicker within an $L_1$ tapered section (a section in which the diameter of the metal wire stock gradually decreases from the downstream side toward the upstream side in the feeding direction of the metal wire stock, the section being hereinafter referred to as "wire diameter gradually decreasing portion") so that the taper will be shorter with a substantially large gradient while the tapered rod becomes thinner within another tapered section $L_2$ (a section in which the diameter of the metal wire stock gradually increases from the downstream side toward the upstream side in the feeding direction, the section being hereinafter referred to as "wire diameter gradually increasing portion") so that the taper will be longer with a substantially small gradient as indicated by solid lines in FIG. 4.

The inventors of the present patent application have made various investigations through several experiments and found out that, in actual tapered working, plastic deformation and its fixation of a metal wire stock do not occur suddenly as in the hypothesis of the model of FIG. 2 but deformation starts at a point further upstream as illustrated in FIG. 5 and that a so-called deforming zone 8 between the deformation starting point and a deformation ending point has an influence upon a profile of a taper of a product.

In particular, if a metal wire stock being worked is instantaneously stopped to observe a profile of a heated portion of the stock in detail in order to examine a deforming condition of the stock in the deforming zone 8, the profile observed is such as illustrated in FIG. 6 and is thus quite different from that of the model of FIG. 2. As seen in FIG. 6, deformation of the heated stock starts at a rear half portion of the heating device 3 and continues to the inside of the cooling device 4.

On the other hand, where a metal wire stock is, for example, made of steel, it is normally heated to a temperature higher than 750° C. for working. Where such heating is advantageously used to heat treat the steel wire stock for hardening, it is heated to a temperature higher than 900° C.

However, it is known that, if a wire stock is worked at such a high temperature, fine cracks having depths of several microns or so will appear along crystal grain boundaries of a surface layer of a product worked from the wire stock.

Then, if a product having such cracks is worked into a part such as, for example, a coil spring which will undergo repetitive loads, when the part is used, it is forecast that the cracks may accelerate fatigue of the product and consequently deteriorate the strength of the product. Accordingly, such a product is not preferable.

SUMMARY OF THE INVENTION

It is an object of the present invention to provide a process by which a taper rod having a profile very near to an aimed profile can be produced with high accuracy.

It is another object of the present invention to provide a process by which a taper rod having a profile very near to a desired profile can be produced while preventing appearance of fine cracks in a surface layer of the tapered rod produced.

The present invention was made perceiving that there exists a deforming zone of a metal wire or bar stock in a location from the inside of a heating device to the inside of a cooling device in a device for for working a metal wire or bar stock into a tapered rod. It was also perceived that few or no fine cracks are caused to appear by preventing a wire or bar stock at a high temperature from contacting with oxygen when the wire or bar stock is being worked.

In order to attain the foregoing objects, according to the present invention, a process of producing a tapered rod using tapered rod producing equipment which includes constant speed feeding means for holding and feeding metal wire or bar stock at a constant speed, a heating device located downstream of said constant speed feeding means in a feeding direction of the metal wire or bar stock, a cooling device located further downstream of said heating device, variable speed feeding means located further downstream of said cooling device for holding and feeding the metal wire or bar stock at a variable speed, whereby the feeding speed of said variable speed feeding means is accelerated to provide the metal wire or bar stock passing between said heating device and said cooling device with plastic deformation in order to form a wire diameter gradually decreasing portion of a taper rod in which the diameter of the metal wire or bar stock gradually decreases, and the feeding speed of said variable speed feeding means is decelerated in order to form a wire diameter gradually increasing portion of the tapered rod in which the diameter of the metal wire or bar stock gradually increases, is characterized in that during working of the wire diameter gradually decreasing portion of the tapered rod, the drawing length of the metal wire or bar stock from starting to ending of the acceleration of said variable speed feeding means is made greater than the desired length of the wire diameter gradually decreasing portion, and during working of the wire diameter gradually increasing portion, the drawing length of the metal wire or bar stock from starting to completion of the deceleration of said variable speed feeding means is made smaller than the desired length of the wire diameter gradually increasing portion of the tapered rod.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
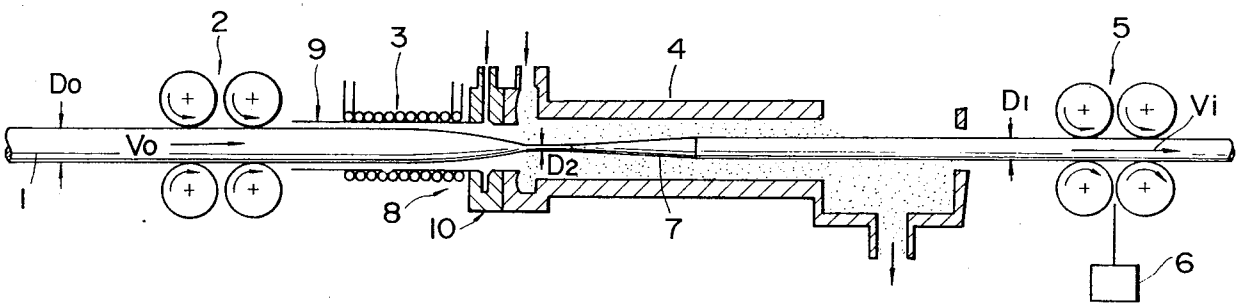
FIGURE 1 (PRIOR ART)
FIG. 1 is schematic representation illustrating a tapered rod producing equipment for carrying out the process of the present invention.
Figure 2:
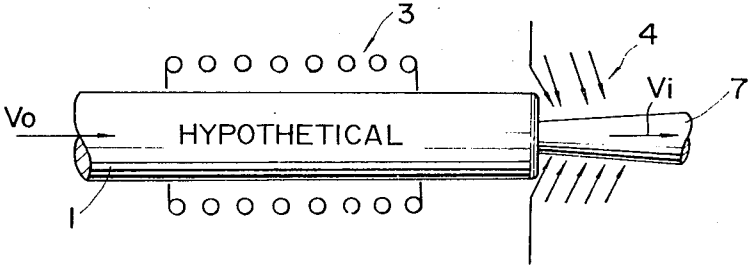
FIGURE 2 (PRIOR ART)
FIG. 2 is a schematic representation illustrating a hypothesis of a conventional working theory.
Figure 3:
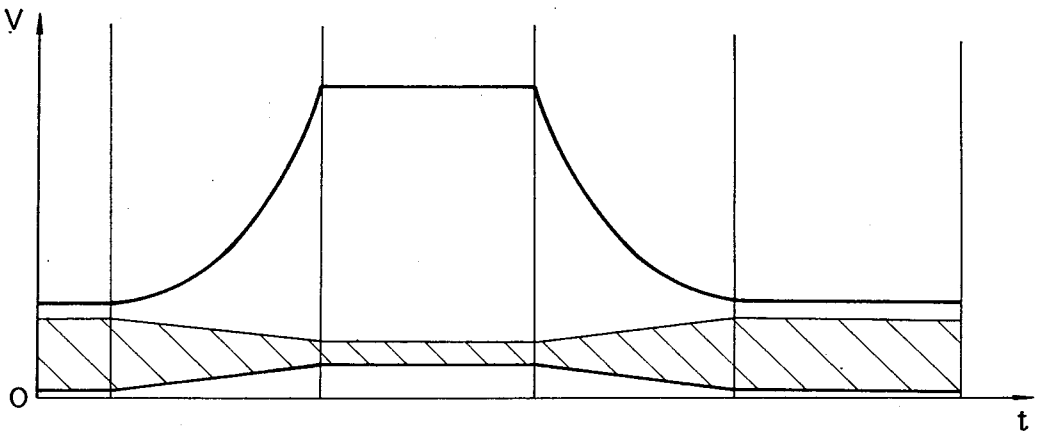
FIGURE 3 (PRIOR ART)
FIG. 3 is a speed—time chart of a variable speed tension roller in accordance with the conventional working theory.
Figure 4:
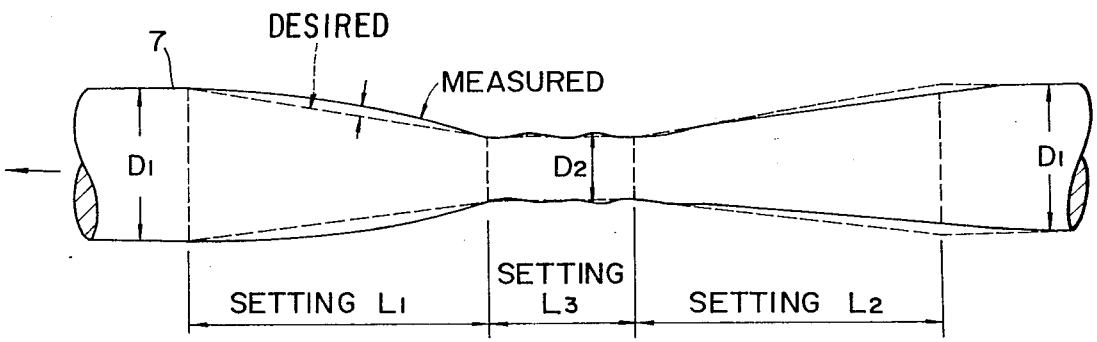
FIGURE 4 (PRIOR ART)
FIG. 4 is a schematic representation illustrating a profile of a taper rod produced in accordance with the conventional working theory.
Figure 5:
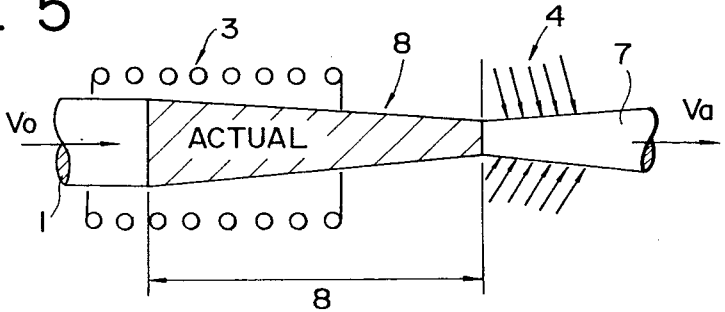
FIG. 5 is a schematic representation illustrating a working theory in accordance with the present invention.
Figure 6:
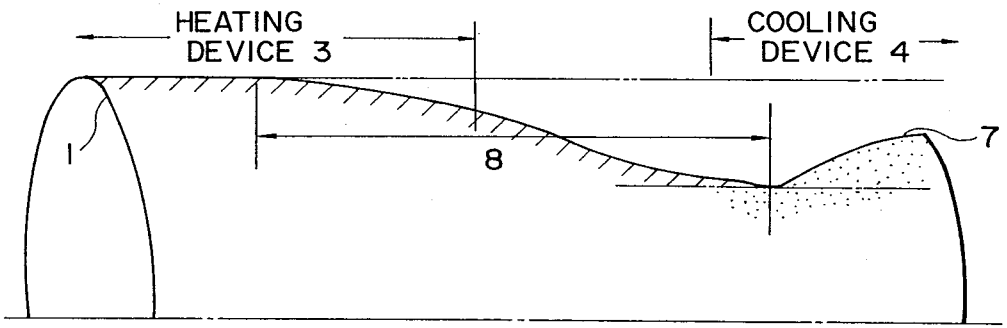
FIG. 6 is a detailed view of part of FIG. 5.
Figure 7:
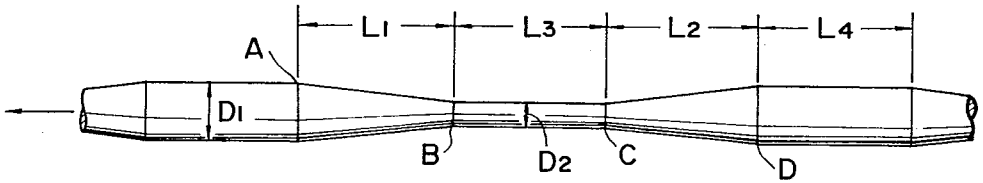
FIG. 7 is a front elevational view illustrating a profile of a taper rod produced in accordance with the process of the present invention.

At first, it was attempted to produce, using such tapered rod producing equipment as shown in FIG. 1, a tapered rod having a profile as shown in FIG. 7 from a straight rouhnd bar of a stock diameter $D_0$ by varying the feeding speed V of tension rollers 5 serving as variable speed feeding means while keeping constant the feeding speed $V_0$ of constant speed rollers 2 serving as constant speed feeding means.

Here, the desired profile of a tapered rod to be produced has following dimensions:

Larger diameter straight portion diameter $$D_1 = D_0 = 13.8 \text{ mm}$$

Smaller diameter straight portion diameter $$D_2 = 10.9 \text{ mm}$$

Larger diameter straight portion length $$L_4 = 550 \text{ mm}$$

Smaller diameter straight portion length $$D_3 = 270 \text{ mm}$$

Wire diameter gradually decreasing portion length

Lth 1=344 mm

Wire diameter gradually increasing portion length

Lth 2=344 mm

Figure 8:
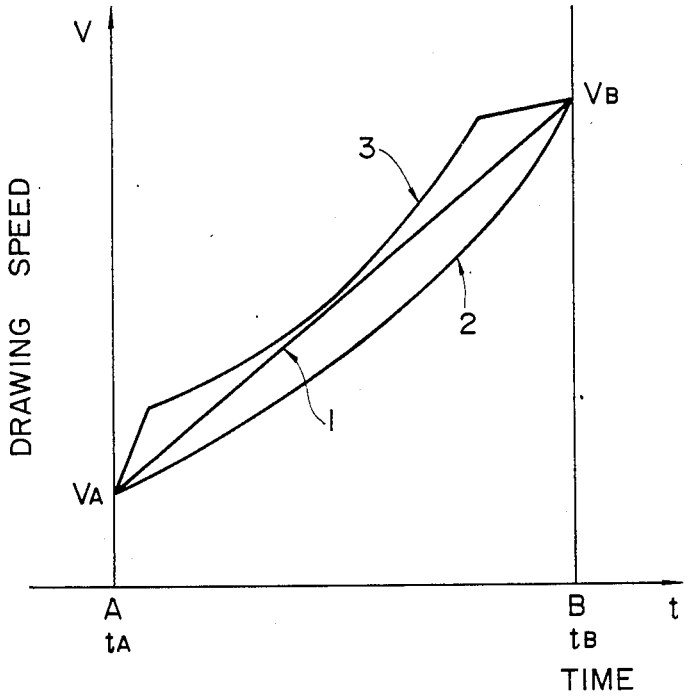
FIG. 8 is a speed—time chart of a variable speed tension roller upon working of a wire diameter gradually decreasing portion of a metal wire stock.

In shaping the wire diameter gradually decreasing portion ($L_1$ taper) of a wire stock, the following equations are applicable:

$$V_A = V_O$$

$$V_B = (D_1/D_2)^2 \cdot V_A$$

where $V_A$ is a feeding speed of the variable speed tension rollers 5 at a wire diameter gradual decrease starting point A in a section A-B on the V-t chart of the variable speed tension rollers shown in FIG. 8, and $V_B$ is a feeding speed of the variable speed tension rollers 5 at a wire diameter gradual decrease ending point B in the section A-B. It is to be noted that $V_B$ is equal to the feeding speed of the variable speed tension rollers 5 during shaping of the smaller diameter straight portion of the tapered rod.

If the feeding speed V of the variable speed tension rollers 5 in the section A-B is varied in accordance with an equation of the first degree as indicated by a curve 1 in FIG. 8, it is given by a following equation:

$$V = V_A + \alpha \cdot t$$

provided here, $$\alpha = \frac{V_B - V_A}{t_B - t_A}$$

Accordingly, the actual drawing length Lreal 1 in the section is given by $$L\text{real } 1 = \int_{t_A}^{t_B} (V_A + \alpha \cdot t)\, dt$$

Thus, tapered rods were produced wherein wire diameter gradually decreasing portions thereof were shaped varying the difference between the Lreal 1 and the Lth 1 above, that is, the overpull amount $\Delta L_1 = L\text{real } 1 - L\text{th } 1$, to three stages of 0 mm, 170 mm and 300 mm, and profiles of the wire diameter gradually degreasing portions of the tapered rods were examined. The results are illustrated in FIG. 9.

It is to be noted that $\Delta L_1$ can be varied by varying $\Delta t = t_B - t_A$.

Figure 9:
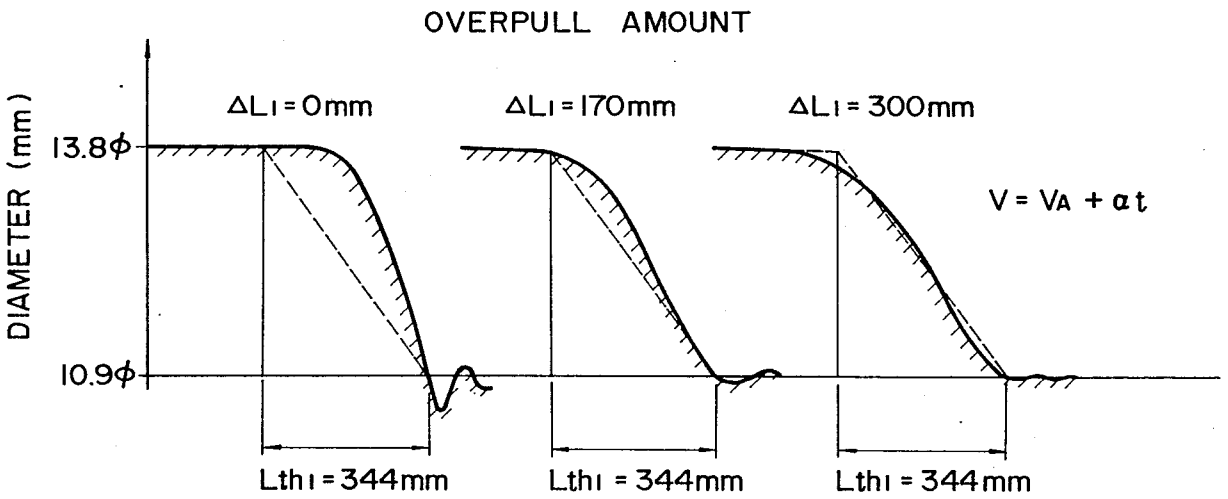
FIG. 9 is a diagram illustrating changes in profile of a wire diameter gradually decreasing portion of a metal wire stock in accordance with changes in overpull amount when the speed of a variable speed tension roller is changed in accordance with an equation of the first degree to work the wire diameter gradually decreasing portion of the metal wire stock.

As can be seen from FIG. 9, in the case where the overpull amount $\Delta L_1 = 0$, that is, where the drawing length of the variable speed tension rollers 5 is equal to the aimed length of a product, the length of the wire diameter gradually decreasing portion is significantly shorter than the aimed length Lth 1=344 mm.

To the contrary, in the case of $\Delta L_1 = 170$ mm and 330 mm, the length and profile of the wire diameter gradually decreasing portion are very near to or substantially coincident with the desired or predetermined length and profile.

On the other hand, if the feeding speed of the variable speed tension rollers 5 in the section A-B is varied in accordance with an equation of the second degree as indicated by a curve 2 in FIG. 8, it is given by a following equation:

$$V = V_A + \alpha \cdot t + \beta \cdot t^2$$

and similarly as in the equation of the first degree, $$L\text{real } 1 = \int_{t_A}^{t_B} (V_A + \alpha \cdot t + \beta \cdot t^2)\, dt$$

$$\Delta L_1 = L\text{real } 1 - L\text{th } 1$$

Figure 10:
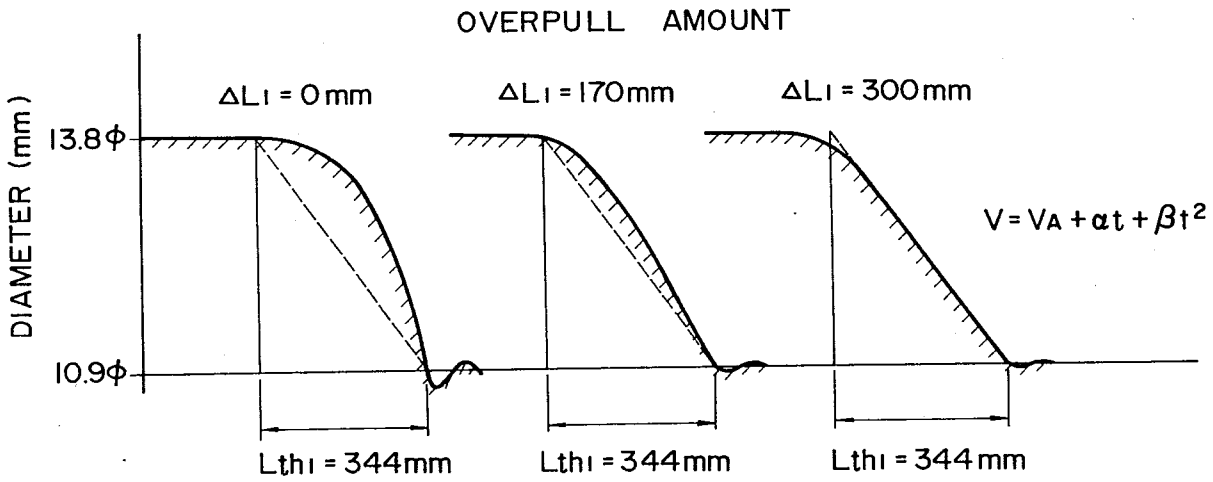
FIG. 10 is a diagram illustrating changes in profile of a wire diameter gradually decreasing portion of a metal wire stock in accordance with changes in overpull amount when the speed of a variable speed tension roller is changed in accordance with an equation of the second degree to work the wire diameter gradually decreasing portion of the metal wire stock.

Thus, profiles of tapered rod wire diameter gradually decreasing portions when $\Delta L_1 = 0$ mm, 170 mm and 300 mm are illustrated in FIG. 10.

Also in the case of FIG. 10, similar tendencies to those of FIG. 9 can be seen, but the profiles of the wire diameter gradually decreasing portions exhibit a more linear variation. It is to be noted that, in FIGS. 9 and 10, a tendency can be observed that the greater the overpull amount $\Delta L_1$, the greater the length of the tapered portion, and there is an optimum value in $\Delta L_1$.

As is apparent from the foregoing description, in order to shape a wire diameter gradually decreasing portion of a metal wire stock 1 into a profile of desired dimensions while passing the metal wire stock 1 from the heating device 3 to the cooling device 4, it is necessary to set the drawing length Lreal 1 of the wire stock from starting to ending of acceleration of the variable speed tension rollers 5 to a value greater than the aimed length Lth 1 of the wire diameter gradually decreasing portion, that is, to take a suitable overpull amount $\Delta L_1$.

It is to be noted that while in FIGS. 9 and 10 the speed variations in the section A-B depend upon equations of the first and second degrees, respectively, if it is intended to make the profile of the wire diameter gradually decreasing portion further closer to a straight one, a more accurate approximate expression may be experimentally suitably produced.

Further, in order to make shapes at starting and ending points of a wire diameter gradually decreasing portion of a wire metal stock more accurate, it is desirable to temporarily increase the acceleration around the starting point of the wire diameter gradually decreasing portion and temporarily decrease the acceleration around the ending point of the wire diameter gradually decreasing portion as indicated by a curve 3 in FIG. 8.

In particular, when a drawing force is caused to act upon a metal wire stock 1 to provide the metal wire stock 1 with plastic deformation, the metal wire stock 1 yields deformation not immediately but after some elastic deformation. Accordingly, the metal wire stock 1 is not deformed just when acceleration of the variable speed tension rollers is started, but its deformation begins after some time lag. In order to minimize the time lag, the acceleration should be increased instantaneously.

Meanwhile, the reason why the acceleration is decreased around the ending point of the wire diameter gradually decreasing portion is that otherwise if the high speed is maintained, it is sometimes difficult to fix the speed to $V_B$ instantaneously at the point in time $t_B$.

Now, the wire diameter gradually increasing portion ($L_2$ taper) will be described. In shaping the $L_2$ taper portion, the feeding speed of the variable speed tension rollers 5 at a wire diameter gradual increase starting point C in a section C-D on the V-t chart of the variable speed tension rollers 5 shown in FIG. 11 is denoted by $V_C$ ($=V_B$), and the feeding speed at a wire diameter gradual increase ending point D in the section C-D is denoted by $V_D$.

Figure 11:
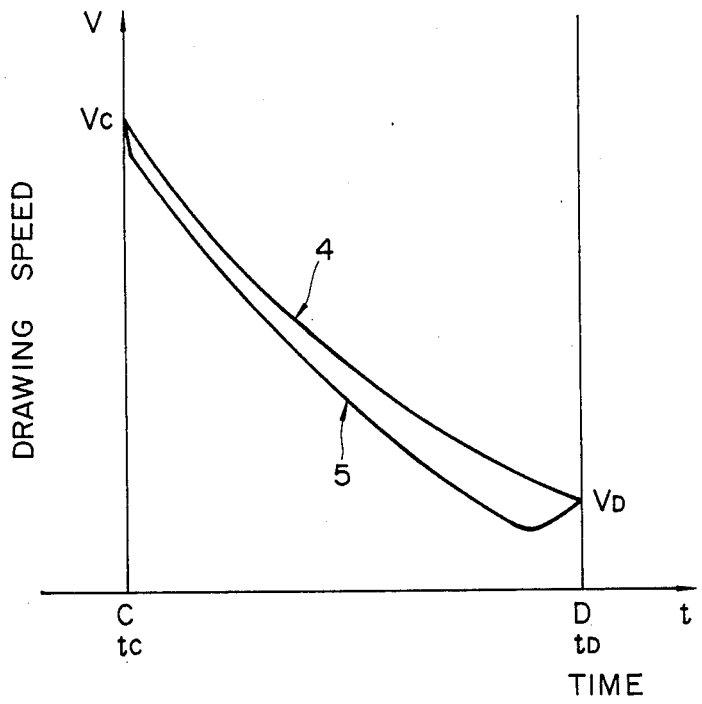
FIG. 11 is a speed—time chart of a variable speed tension roller upon working of a wire diameter gradually increasing portion of a metal wire stock.

If the speed of the variable speed tension rollers 5 in the section C-D is varied in accordance with an equation of the second degree as indicated by a curve 4 in FIG. 11, the speed in the section is represented by a following expression:

$$V=V_D-\gamma\cdot t+\delta\cdot t^2$$

Accordingly, the actual drawing length Lreal 2 in the section is given by $$L\text{real } 2 = \int_{t_C}^{t_D} (V_D - \gamma \cdot t + \delta \cdot t^2)\, dt$$

Thus, tapered rods were produced wherein wire diameter gradually increasing portions were shaped varying the difference between Lth 2 and Lreal 2, that is, the underpull amount $\Delta L_2$ given by $$\Delta L_2 = L\text{th } 2 - L\text{real } 2$$

to 3 stages of $\Delta L_2=0$ mm, 100 mm and 170 mm, and profiles of the thus produced tapered rods were examined. The results are illustrated in FIG. 12.

Figure 12:
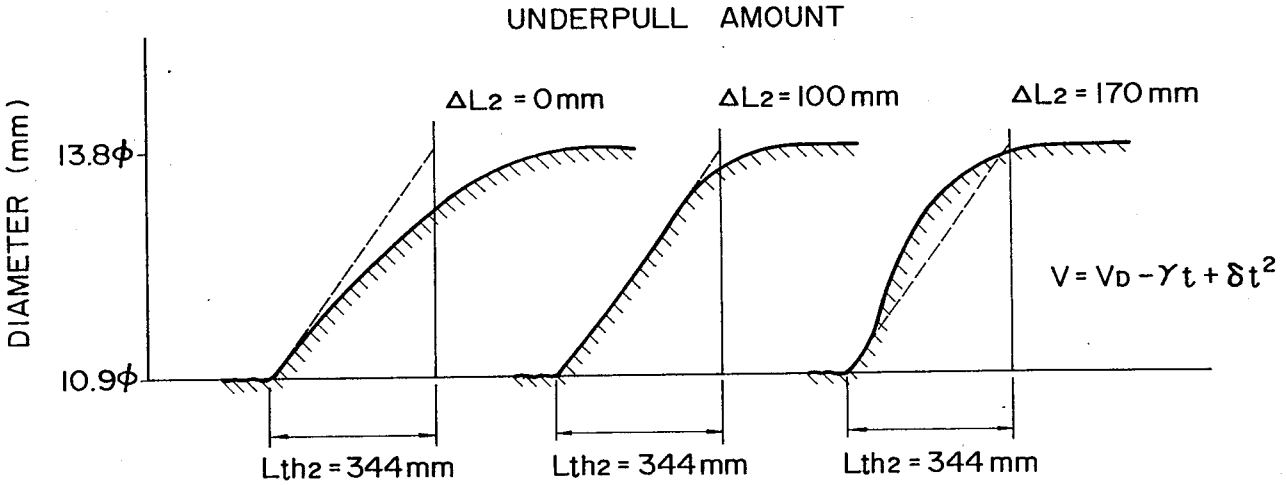
FIG. 12 is a diagram illustrating changes in profile of a wire diameter gradually increasing portion in accordance with changes in underpull amount.

As can be seen from FIG. 12, in the case of the underpull amount $\Delta L_2=0$, that is, where the drawing length of the variable speed tension rollers is equal to the desired length of a product, the length of the wire diameter gradually increasing portion is significantly longer than the desired length of 344 mm. To the contrary, in the case of $\Delta L_2=100$ mm, the length and profile of the wire diameter gradually increasing portion are substantially coincident with the desired length and profile. However, in the case of $\Delta L_2=170$ mm, the length of the wire diameter gradually increasing portion is too small. Accordingly, it will be appreciated that there is an optimum value in $\Delta L_2$.

As apparent from the foregoing description, in order to shape a wire diameter gradually increasing portion of a metal wire stock into a profile of desired dimensions, it is necessary to set the drawing length Lreal 2 of the wire stock from starting to completion of deceleration of the variable speed tension rollers to a value smaller than the desired length Lth 2 of the wire diameter gradually increasing portion, that is, to take a suitable underpull amount $\Delta L_2$.

Also in work of a wire diameter gradually increasing portion, in order to approximate the tapered shape to a linear one and further make shapes at starting and completion points of a wire diameter gradually increasing portion of a wire metal stock more accurate, it is desirable to temporarily increase the deceleration around the starting point of the wire diameter gradually increasing portion and temporarily decrease the deceleration (or accelerate) around the ending point of the wire diameter gradually increasing portion (refer to a curve 5 shown in FIG. 11).

Here, prevention of appearance of fine cracks in a surface layer of a tapered rod will be described with reference to FIG. 1. The tapered rod producing equipment shown further includes an oxidation preventing housing 8 located at the same location with the work coil or heating device 3 along the feeding direction of the wire stock 1. Thus, the oxidation prevention housing 8 is constructed such that the wire stock 1 may pass the inside thereof and includes a cylindrical member 9 of a ceramics material or the like fitted in the work coil 3, and a ring-formed gas supply member 10 securely mounted at a forward end of the cylindrical member 9 along the feeding direction of the wire stock 1. It is to be noted that a ring-formed seal member may be provided at the opposite rear end of the cylindrical member 9 in order to promote a sealing effect.

The gas supply member 10 is supplied with nonoxidizing gas such as $N_2$ gas, Ar gas or denatured gas from an external gas supply apparatus (not shown) to isolate the wire stock 1 at a high temperature (700° to 1000° C. where the wire stock 1 is made of steel) within the work coil 3 from oxygen.

In this manner, the wire stock 1 is heated to a predetermined temperature by the heating device 3 within such a non-oxidizing atmosphere as described above and then cooled within the cooling device 4 which is filled with coolant. After all, during working of the wire stock 1, while the wire stock 1 is maintained at a high temperature (for example, a temperature higher than 500° C.), it is prevented from contacting with oxygen. As a result of working of the wire stock 1 under such circumstances, few or no fine cracks will appear in a surface layer of the wire stock 1. Accordingly, a product having good surface quality can be obtained.

It is to be noted that it is possible to provide, in place of the oxidation preventing housing 9 as shown in FIG. 1, a film forming device such as, for example, a nickel plating device or an oxidation preventing coating device for forming a film on an outer periphery of a wire stock for preventing the wire stock from contacting with oxygen, between the constant speed feeding means (i.e. constant speed rollers) i.e. 2 and the heating device (i.e. work coil) i.e. 3.

Now, an embodiment of the present invention will be described.

Figure 13:
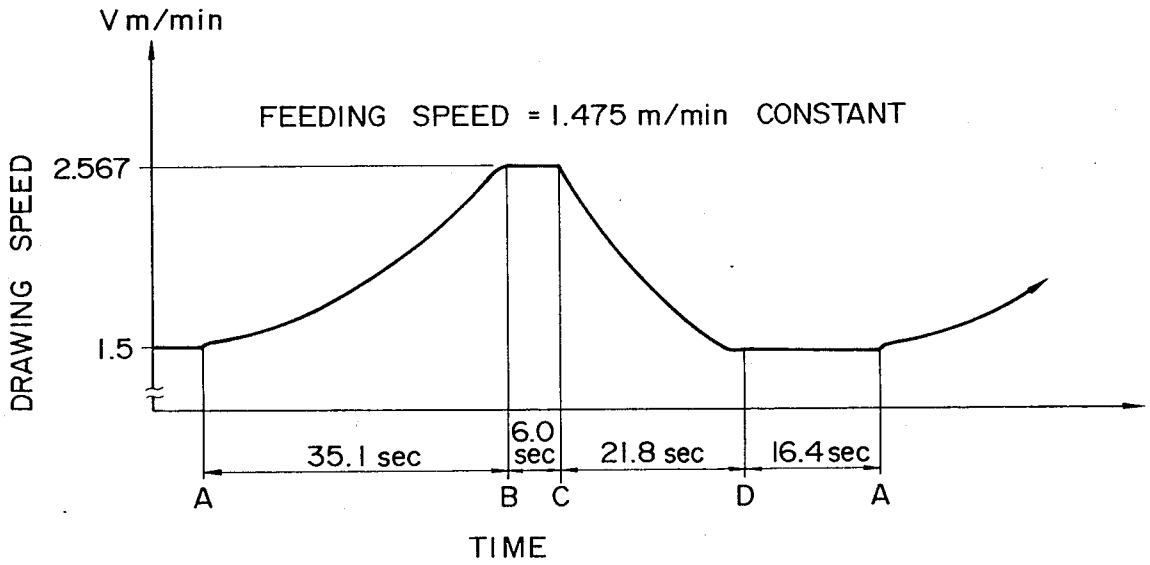
FIG. 13 is a speed—time chart of a variable speed tension roller according to an embodiment of the present invention.
Figure 14:
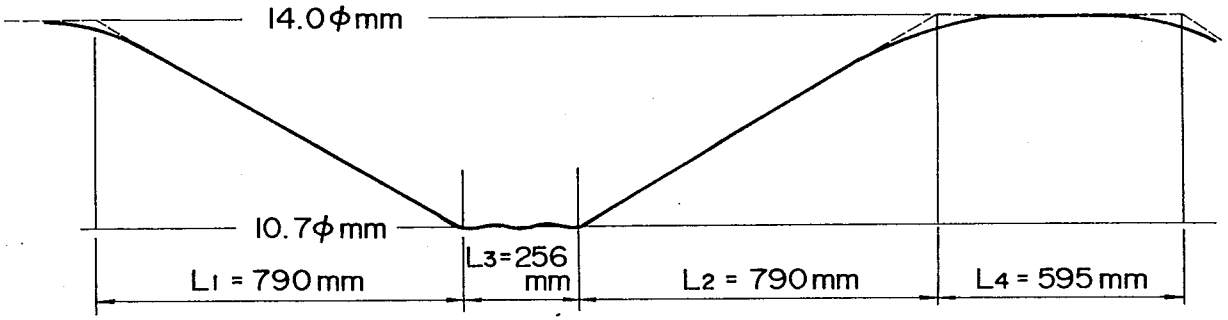
FIG. 14 is a diagram illustrating a profile of a taper rod produced by the process of the embodiment of the present invention illustrated in FIG. 13.

Tapered rods were produced using the equipment as shown in FIG. 1. Details of a sample stock used and a tapered rod to be produced were as follows:

- Sample stock: low alloy steel wire 14.12 mm $\phi$ (C 0.56%, Si 1.44%, Mn 0.72%, Cr 0.72%, the rest being Fe and impurities)
- Profile of tapered rod (aimed)
  - Larger diameter straight portion: Diameter 14.0 mm, Length 595 mm
  - Smaller diameter straight portion: Diameter 10.7 mm, Length 256 mm
  - Tapered portion (wire diameter gradually decreasing portion, wire diameter gradually increasing portion): Length 790 mm Meanwhile, working conditions were as follows:

- Heating: high-frequency heating device (with oxidation preventing housing and supply of $N_2$ gas)
  Highest heating temperature 950° C.
- Cooling: ring nozzle cooling device water soluble quenching liquid (concentration 20%)
- Working speed, overpull amount, underpull amount
  - Working of large diameter straight portion: drawing speed=1.5 m/min
  - Working of small diameter straight portion: drawing speed=2.567 m/min
  - Feeding speed by constant speed feed rollers=1.475 m/min
- Working of wire diameter gradually decreasing portion Working speed: as illustrated in FIG. 13
Overpull amount ($\Delta L_1$): 327 mm Working of wire diameter gradually increasing portion
Working speed: as illustrated in FIG. 13
Underpull amount ($\Delta L_2$): 93 mm A profile of a tapered rod actually produced is illustrated in FIG. 14. In FIG. 14, the profile of the actually produced tapered rod is indicated by a solid line, and it can be seen, from comparison with an desired profile which is indicated in a broken line in FIG. 14, that the desired profile is nearly attained with desired dimensions. Besides, the tapered rod has good surface quality with few or no fine cracks appearing in a surface layer thereof.

As is apparent from the foregoing description, the process according to the present invention is advantageous in that, in producing a tapered rod from a straight metal wire stock using a so-called heating drawing shaping method, a tapered rod of which tapered portions (a wire diameter gradually decreasing portion and a wire diameter gradually increasing portion) have almost desired lengths and profiles can be produced readily, and accordingly a tapered rod of a very high quality as a stock for a tapered coil spring for use with an automobile, a railway vehicle and so on can be obtained efficiently.

Having now fully described the invention, it will be apparent to one of ordinary skill in the art that may changes and modifications can be made thereto without departing from the spirit and scope of the invention as set forth herein.

What is claimed is:

1. A process for producing a tapered rod using a tapered rod producing apparatus which includes constant speed feeding means for holding and feeding a metal wire or bar stock at a constant speed, a heating device located downstream of said constant speed feeding means in a feeding direction of the metal wire or bar stock, a cooling device located further downstream of said heating device, variable speed feeding means located further downstream of said cooling device for holding and feeding the metal wire or bar stock at a variable speed, wherein the process comprises:

accelerating the feeding speed of said variable speed feeding means to provide the metal wire or bar stock passing between said heating device and said cooling device with plastic deformation in order to form a wire diameter gradually decreasing portion of a predetermined length of a tapered rod in which the diameter of the metal wire or bar stock gradually decreases;

decelerating the feeding speed of said variable speed feeding means in order to form a wire diameter gradually increasing portion of a predetermined length of the tapered rod in which the diameter of the metal wire or bar stock gradually increases;

during working of the wire diameter gradually decreasing portion of the tapered rod, making a drawing length of the metal wire or bar stock from starting to completion of the acceleration of said variable speed feeding means greater than said predetermined length of the wire diameter gradually decreasing portion, and during working of the wire diameter gradually increasing portion, making smaller the drawing length of the metal wire or bar stock from starting to ending of the deceleration of said variable speed feeding means than said predetermined length of the wire diameter gradually increasing portion of the tapered rod.

2. A process for producing a tapered rod according to claim 1, which further comprises, during working of the wire diameter gradually decreasing portion of the tapered rod, temporarily increasing the acceleration of said feeding speed upon starting of the working and temporarily decreasing deceleration of said feeding speed upon completion of the working.

3. A process of producing a tapered rod according to claim 1, which further comprises, during working of the wire diameter gradually increasing portion of the tapered rod, temporarily increasing the deceleration of said feeding speed upon starting of the working, and temporarily decreasing deceleration of said feeding speed upon completion of the working.

4. A process of producing a tapered rod according to claim 1, which further comprises during working of the metal wire or bar stock, preventing the metal wire or bar stock at a high temperature from contacting with oxygen.

5. A process of producing a tapered rod according to claim 4, which further comprises surrounding the metal wire or bar stock at a high temperature by a non-oxidizing atmosphere.

6. A process of producing a tapered rod according to claim 4, which further comprises forming a film for preventing the metal wire or bar stock from contacting with oxygen on an outer periphery of the metal wire or bar stock before heating of the metal wire or bar stock.

* * * * *